US005206447A

United States Patent [19]

Yamaguchi et al.

[11] Patent Number: 5,206,447

[45] Date of Patent: Apr. 27, 1993

[54] ELECTRONIC MUSICAL INSTRUMENT HAVING AN AD-LIBBING FUNCTION

[75] Inventors: Masafumi Yamaguchi, Hamamatsu; Hideki Takahashi, Iwata, both of Japan

[73] Assignee: Kawai Musical Instruments Manufacturing Co., Ltd., Hamamatsu, Japan

[21] Appl. No.: 444,757

[22] Filed: Dec. 1, 1989

[30] Foreign Application Priority Data

Dec. 4, 1988 [JP] Japan ..... 63-306507

[51] Int. Cl.[5] ..... G10H 7/00; G10H 1/40

[52] U.S. Cl. ..... 84/635; 84/637

[58] Field of Search ..... 84/600-604, 84/610, 611, 613, 634, 635, 637

[56] References Cited

U.S. PATENT DOCUMENTS 4,344,345 8/1982 Sano ..... 84/635
4,368,658 1/1983 Deutsch et al. ..... 84/637
4,534,257 8/1985 Mitarai ..... 84/637
4,616,547 10/1986 Mancini et al. .
4,706,538 11/1987 Yoshida .
4,708,046 11/1987 Kozuki .
4,757,736 6/1988 Tajima et al. ..... 84/667
4,882,964 11/1989 Okamoto et al. ..... 84/611
4,893,538 1/1990 Masaki et al. ..... 84/605
4,926,736 5/1990 Kozuki ..... 84/610

FOREIGN PATENT DOCUMENTS

3221447A1 12/1982 Fed. Rep. of Germany .

OTHER PUBLICATIONS

Ser. No. 06/274,606, by George R. Hill et al., filed Jun. 1981.

*Primary Examiner*—Stanley J. Witkowski
*Assistant Examiner*—Jeffrey W. Donels
*Attorney, Agent, or Firm*—Koppel & Jacobs

[57] ABSTRACT

An electronic keyboard or similar electronic musical instrument having an automatic rhythm playing function and an ad-libbing function. The instrument includes keys to which an ad-libbing function is assigned. When one presses any of the ad-libbing keys on the keyboard, the instrument allows the operator to feel as if the operator were performing an ad-lib. Various kinds of ad lib plays are available by looping note data representative of a single melody or by transforming the note data to a plurality of melodies by chord detection.

4 Claims, 9 Drawing Sheets

| O F A | MODE SW | AUTO RHYTHM | INTERNAL CODE (SEQUENCE OR MANUAL) | | LOWER KEYS | OFA AREA KEYS (17) | UPPER KEYS | OFA MELODY | BASS CHORD |
|---|---|---|---|---|---|---|---|---|---|
| ON | NORMAL | OFF | *1 INTERNAL SEQUENCE | | MELODY | (A) AD LIB PATTERNS ASSOCIATED WITH INDIVIDUAL KEYS ARE REPETIVELY READ OUT AND DEVELOPED BY INTERNAL SEQUENCE | MELODY | O | X |
| | | ON | INTERNAL SEQUENCE | | MELODY | | | | O (AUTO) |
| | AUTO | OFF | MANUAL WHEN LOWER KEY IS PRESSED | INTERNAL WHEN NOT PRESSED | DETERMINED BASS/CHORDS | (B) CHORDS ARE DETERMINED BY LOWER-ON MANUAL, ROTATION OCCURRING ACCORDINGLY. SAME AS (A) IF LOWER KEY IS NOT PRESSED | MELODY | O | O (MANUAL) |
| | | ON | MANUAL WHEN LOWER KEY IS PRESSED | INTERNAL WHEN NOT PRESSED | ONLY DETERMINATION OF CHORDS (NO SOUND) | SAME AS (B) | MELODY | O | O (AUTO) |
| | DRUM | OFF | INTERNAL SEQUENCE | | DRUM SOUND | SAME AS (A) | MELODY | O | X |
| | | ON | INTERNAL SEQUENCE | | DRUM SOUND | | | O | O (AUTO) |

Fig. 9A

| O F A | MODE SW | AUTO RHYTHM | INTERNAL CODE (SEQUENCE OR MANUAL) | | LOWER KEYS | OFA AREA KEYS (17) | UPPER KEYS | OFA MELODY | BASS CHORD |
|---|---|---|---|---|---|---|---|---|---|
| ON | NORMAL | OFF | ※1 INTERNAL SEQUENCE | | MELODY | (A) AD LIB PATTERNS ASSOCIATED WITH INDIVIDUAL KEYS ARE REPETIVELY READ OUT AND DEVELOPED BY INTERNAL SEQUENCE | MELODY | O | × |
| | | ON | INTERNAL SEQUENCE | | MELODY | | | | O (AUTO) |
| | AUTO | OFF | MANUAL WHEN LOWER KEY IS PRESSED | INTERNAL WHEN NOT PRESSED | DETERMINED BASS/CHORDS | (B) CHORDS ARE DETERMINED BY LOWER-ON MANUAL, ROTATION OCCURRING ACCORDINGLY. SAME AS (A) IF LOWER KEY IS NOT PRESSED | MELODY | O | O (MANUAL) |
| | | ON | MANUAL WHEN LOWER KEY IS PRESSED | INTERNAL WHEN NOT PRESSED | ONLY DETERMINATION OF CHORDS (NO SOUND) | SAME AS (B) | MELODY | O | O (AUTO) |
| | DRUM | OFF | INTERNAL SEQUENCE | | DRUM SOUND | SAME AS (A) | MELODY | O | × |
| | | ON | INTERNAL SEQUENCE | | DRUM SOUND | | | O | O (AUTO) |

Fig. 9B

| O F A | MODE SW | AUTO RHYTHM | INTERNAL CODE (SEQUENCE OR MANUAL) | LOWER KEYS | OFA AREA KEYS (17) | UPPER KEYS | OFA MELODY | BASS CHORD |
|---|---|---|---|---|---|---|---|---|
| OFF | NORMAL | OFF | NOT READ WHEN OFA IS OFF | MELODY | MELODY | MELODY | × | × |
| | | ONLY DRUM ON (BY RHYTHM START) | NO READ WHEN OFA IS OFF | MELODY | | | | |
| | AUTO | OFF | | DETERMINED BASS/CHORD | MELODY | MELODY | × | O (MANUAL) |
| | | ON | | ONLY DETERMINATION OF CHORDS (NO SOUND) | MELODY | MELODY | × | O (AUTO) |
| | DRUM | OFF | | DRUM SOUND | MELODY | MELODY | × | × |
| | | ON (DRUM ONLY) | | DRUM SOUND | | | × | × |

ELECTRONIC MUSICAL INSTRUMENT HAVING AN AD-LIBBING FUNCTION

BACKGROUND OF THE INVENTION

The present invention relates to an improvement in an electronic keyboard or similar electronic musical instrument having an automatic rhythm playing function and, more particularly, to an electronic musical instrument capable of performing improvisation or ad lib by using keys which lie in a particular range on a keyboard.

Some electronic musical instruments such as an electronic keyboard are provided with an automatic rhythm playing capability. The automatic rhythm playing capability is such that when a chord form is pressed by keys that lie in a particular range, for example, a bass and chord accompaniment is automatically developed. The system may be simplified such that a bass and chord accompaniment, for example, is developed in a particular rhythm without resorting to the manipulation of the keys. However, the automatic rhythm playing function available with the prior art electronic musical instruments is limited to "automatic rhythm play" and "automatic rhythm accompaniment coincident with automatic rhythm play", i.e., it cannot play a melody automatically and, hence, an operator has to play a melody part. More specifically, a melody play matching an automatic rhythm play cannot be affected without resorting to the actual manipulation of keys. Such an electronic musical instrument lacking an improvising function estranges persons who are interested in the instrument but not well trained musically, giving rise to a serious problem in the aspect of cultivation of artistic sentiments.

SUMMARY OF THE INVENTION

It is therefore an object of the present invention to provide an electronic musical instrument having an improvising function which allows even an untrained person to enjoy ad-libbing simply by pressing keys to which the particular function is assigned.

It is another object of the present invention to provide a generally improved electronic musical instrument.

In accordance with the present invention, an electronic musical instrument having an ad-libbing function comprises a keyboard having a plurality of keys arranged thereon, a key assigner, a store for storing data representative of tone waveforms, a tone generating circuit, a system control circuit for controlling, when any of the keys on the keyboard are pressed, the key assigner and tone generating circuit to generate tones associated with the pressed keys, and an automatic rhythm playing circuit, the keys on the keyboard being used for ad-libbing.

Also, in accordance with the present invention, an electronic musical instrument having an ad-libbing function comprises a keyboard having a plurality of keys arranged thereon, a key assigner, a store for storing tone waveforms, a tone generating circuit, a system control circuit for controlling, when any of the keys are pressed, the key assigner and tone generating circuit to generate tones associated with the pressed keys, and automatic rhythm playing circuit, a mode selecting switch for selectively setting up a normal play mode, an automatic play mode, and a drum play mode, and an ad lib selecting switch for setting up an ad lib play mode in which a predetermined range on the keyboard is designed and the keys lying in the predetermined range are allocated for an ad-lib play.

Further, in accordance with the present invention, an electronic musical instrument having an ad-libbing function comprises a keyboard having a plurality of keys arranged thereon, a key assigner, a first store for storing tone waveforms, a tone generating circuit, a system control circuit for controlling, when any of the keys on the keyboard are pressed, the key assigner and tone generating circuit to generate tones associated with the pressed keys, a second store for storing data representative of rhythm patterns and kinds of codes of rhythms, an automatic rhythm playing circuit for playing rhythms by reading the data representative of rhythm patterns and the kinds of codes of rhythms, a mode selecting switch for selectively setting up a normal play mode in which the keys on the keyboard are used to produce normal sound for a normal play, an automatic play mode having a function of executing an automatic play by assigning one or more of the keys on the keyboard which lie in a particular range as keys for automatic accompaniment while assigning the other keys as keys for a normal sound play, and a drum play mode having a function of executing a drum play by assigning the keys lying in a prescribed range as keys for percussive sounds while assigning the other keys as keys for a normal sound play, and an ad lib selecting switch for setting up an ad lib play mode by designating a predetermined range on the keyboard and assigning the keys lying in the predetermined range as keys for an ad lib play.

BRIEF DESCRIPTION OF THE DRAWINGS

The above and other objects, features and advantages of the present invention will become more apparent from the following detailed description taken with the accompanying drawings in which:

FIG. 2 shows a specific relationship between seventeen keys located in an OFA area of FIG. 2 and an ad lib pattern memory;

FIG. 9A and 9B are tables listing functions available with the present invention with respect to various modes.

DESCRIPTION OF THE PREFERRED EMBODIMENT

Figure 1:
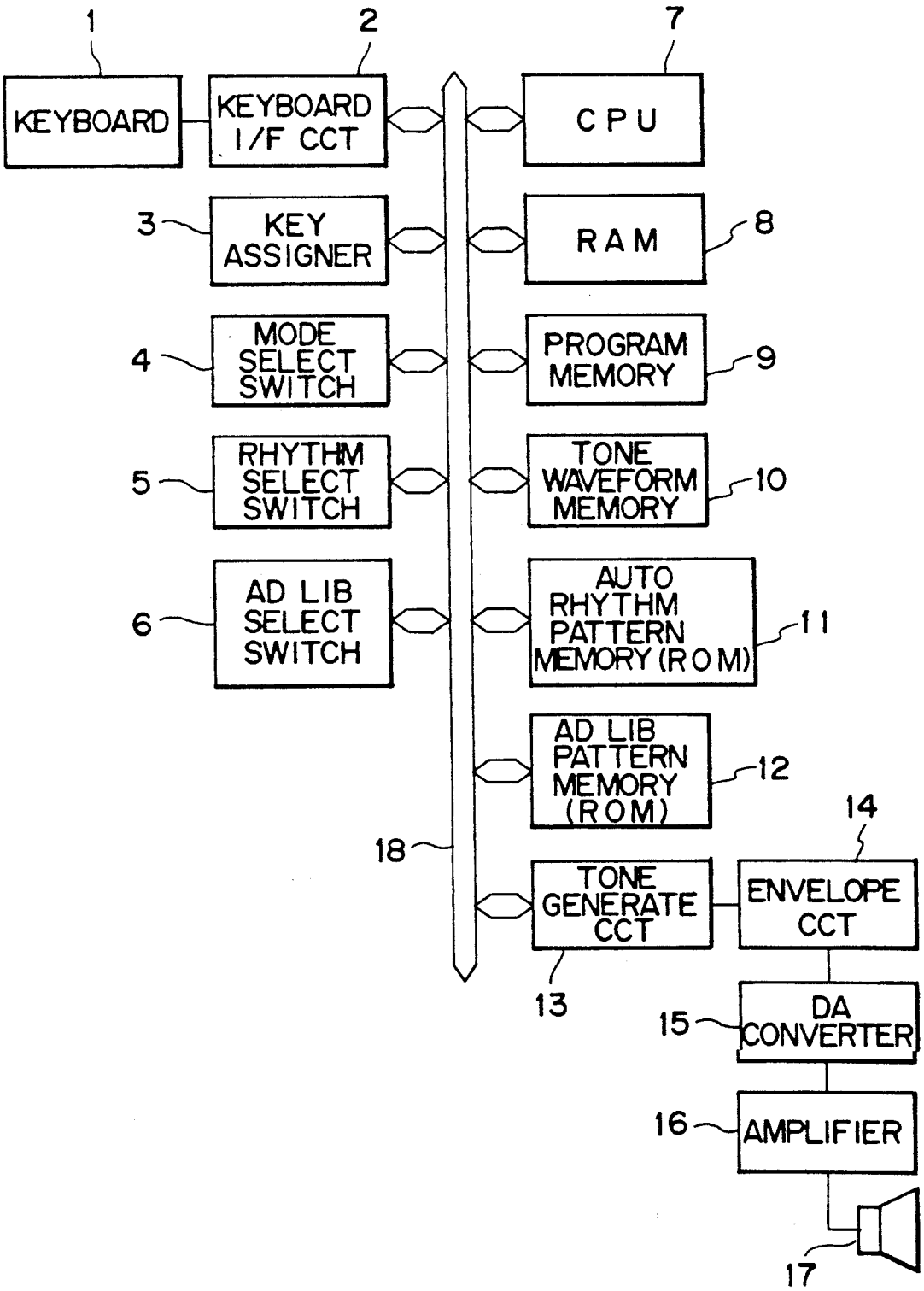
FIG. 1 is a schematic block diagram showing an essential part of an electronic musical instrument embodying the present invention.

Referring to FIG. 1 of the drawings, an electronic musical instrument embodying the present invention is shown. As shown, the instrument has a keyboard 1, a keyboard interface (I/F) circuit 2, a key assigner 3, a mode selecting switch 4, a rhythm selecting switch 5, an ad lib selecting switch 6, a CPU (Central Processing Unit) 7, a RAM (Random Access Memory) 8, a program memory 9, a tone waveform memory 10, a pattern memory 11 adapted for automatic rhythm plays, a pattern memory 12 adapted for ad lib plays, a tone generating circuit 13, an envelope circuit 14, a digital-to-analog (DA) converter 15, an amplifier 16, acoustics 17, and a system bus 18. A difference between the instrument of FIG. 1 and prior art instruments of the type concerned is that the former has the ad lib selecting switch 6 and exclusive pattern memory 12 for ad lib. To better understand the present invention, a part of the illustrative embodiment which is essentially similar to the prior art will be described first.

The keyboard 1 is provided with a plurality of scale keys and manipulated in the event of a play. Specifically, when any of the keys on the keyboard 1 is pressed, key data is generated via the keyboard I/F circuit 2 and system bus 18 so that tone waveform data is read out of an associated address of the tone waveform memory 10. The tone waveform data is fed to the tone generating circuit 13, envelope circuit 14, DA converter 15, amplifier 16 and acoustics 17 to produce a tone associated with the pressed key. The key assigner 32 selectively assigns a key signal or key data entered on the keyboard 1 to the tone generating circuit 13, chord detection, designation of a drum sound source, etc. The mode selecting switch 4 is accessible for selecting one of three different modes, i.e., a normal play mode, an automatic play mode, and a drum play mode. The rhythm selecting switch 5 is operable to select a desired kind of automatic rhythm play. The CPU 7 controls the entire system of the instrument. The RAM 8 is a system memory for storing data which is necessary for the control over the instrument system and so forth. The program memory 9 stores various kinds of programs such as a program for controlling the tone generating sequence and a program for controlling the instrument system. The tone waveform memory 10 stores data representative of tone waveforms. Further, the pattern memory 11 for automatic rhythm plays stores data representative of bass/chord patterns for automatic rhythm plays, i.e., rhythm patterns and the kinds of chords of rhythms.

Hereinafter will be described unique functions available with the present invention.

Figure 2:
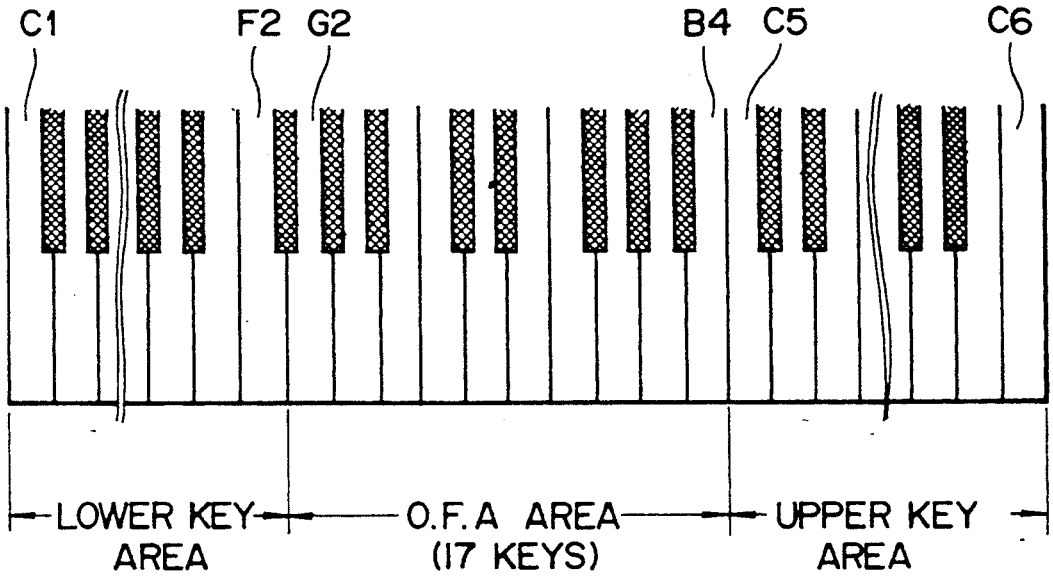
FIG. 2 is a fragmentary view of a keyboard of the instrument shown in FIG. 1, indicating a specific assignment of functions to keys on the keyboard.

Referring to FIG. 2, a specific assignment of functions to the keys of the keyboard 1 is shown. As shown, the keyboard 1 is segmented into three different areas, i.e., a lower key area having the lowest range keys $C_1$ to $F_2$, a one-finger ad lib (OFA) area having medium range keys $G_2$ to $B_4$, and an upper key area having the highest range keys $C_5$ to $C_6$. In the illustrative assignment, therefore, the medium range keys $G_2$ to $B_4$ in the OFA area serve as function keys for executing ad lib plays. While the keyboard shown in FIG. 2 is implemented as a single keyboard, it may be physically divided at predetermined one to three points. When the keyboard is divided into two, for example, upper keys and lower keys with respect to the point of division will be respectively assigned to the higher range and the lower range as with an ordinary two-board type keyboard. The keyboard of FIG. 2 has the OFA area between the upper and lower areas and is, therefore, divided into three key areas.

Figure 3:
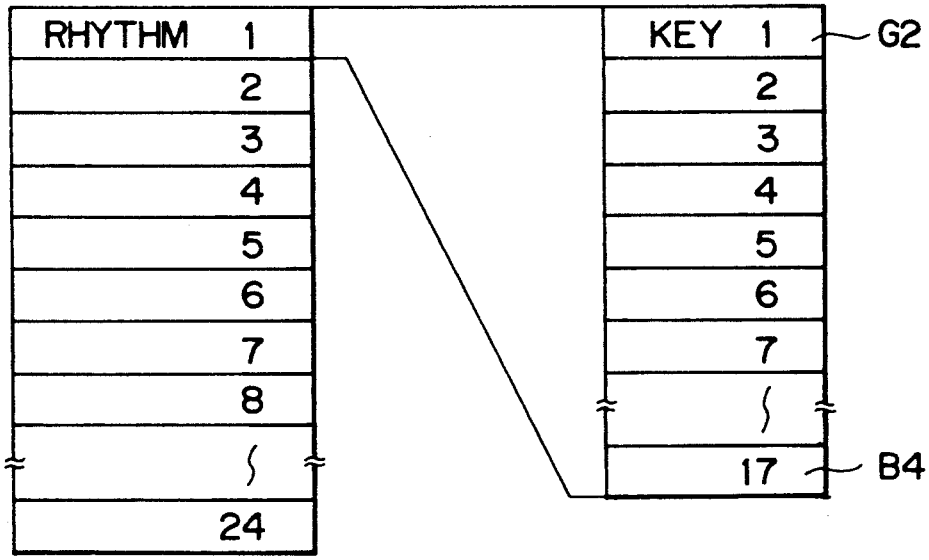

FIG. 3 indicates a relationship between the seventeen keys positioned in the OFA area of the keyboard and the ad lib pattern memory 12. As shown, the ad lib pattern memory 12 has twenty-four areas, for example, which correspond to "MELODY" and "RHYTHM" which will be described with reference to FIG. 4. The memory areas individually store ad lib pattern data which are associated with keys 1 to 17, i.e., the keys $G_2$ to $B_4$. Since the pattern differs from one rhythm to another, 408 different kinds of pattern data ($=24\times17$) are stored in the illustrative embodiment. When any of the seventeen keys located in the OFA area is pressed, data associated with the pressed key is read out of the pattern memory 12 and fed to the tone generating circuit 13 to produce a tone. At this instant, tone control is executed such that, on the manipulation of a key, tone to be generated is read out of a tone data table area associated with an ad lib pattern and temporarily stored in a memory, e.g. a particular area of the RAM 8, FIG. 1 (step S27, FIG. 6). The pattern data may be note data covering one or two measures or even one half or one quarter of a measure or a greater number of measures. However, an increase in the number of measures directly translates into an increase in the required capacity of the pattern memory 12. To save the memory capacity and considering the cost of memories available today, the number of measures should preferably be limited to one or two and this is sufficient in practice.

Figure 4:
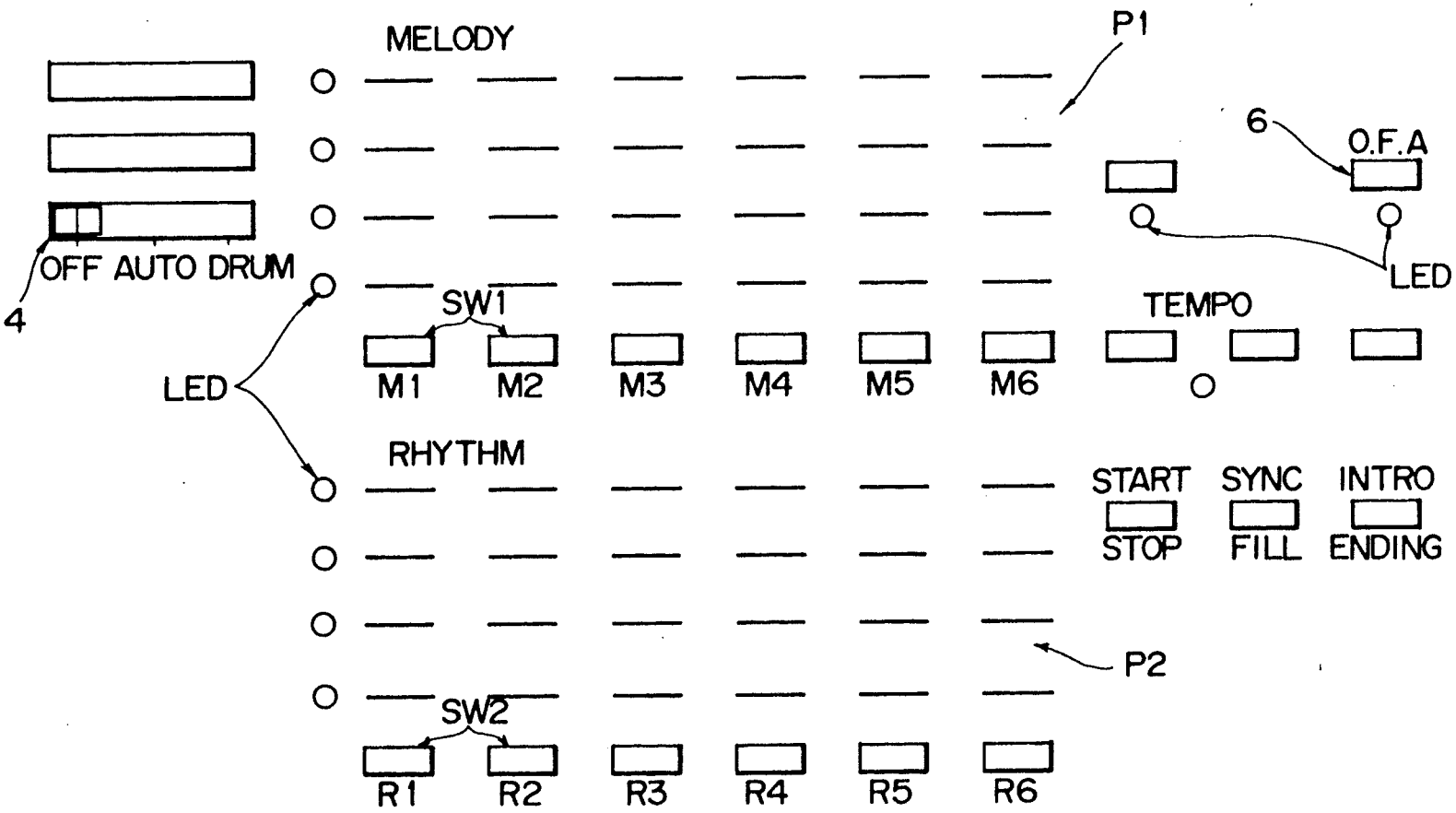
FIG. 4 is a schematic view showing a specific arrangement of an essential part of a control panel which is provided on the instrument of FIG. 1.

Referring to FIG. 4, there is shown a part of a specific arrangement of a control panel which forms a part of the instrument of the present invention. In the figure, the same reference numerals as those shown in FIG. 1 designate the same components. As shown, the control panel has light emitting diodes LED, a group of switches SW1 for selecting a desired kind of memory, a group of switches SW2 for selecting a desired kind of rhythm, a display section P1 (labeled "MELODY") for displaying the selected melody, and a display section P2 (labeled "RHYTHM") for displaying the selected rhythm. The ad lib selecting switch 6 is one of characteristic features of the present invention, as stated earlier. The mode selecting switch 4 is operated to a position "OFF" for a normal play mode, to a position "AUTO" for an automatic play mode, and to a position "DRUM" for a drum play mode. The ad lib selecting switch 6 designates the predetermined OFA area of the keyboard and assigns a different ad lib pattern to each of the keys in the OFA area, so that an ad lib may be executed. At the same time, the switch 6 assigns to the keys located in the other ranges on the keyboard the role of keys for implementing a normal play, automatic play or drum play as selected by the mode selecting switch 4. The functions assigned to the individual keys are supervised by the key assigner 3.

When one operates the ad lib selecting switch 6 to set up an ad lib play mode and then presses one of the keys in the OFA area shown in FIG. 2, pattern data is read out of the associated area or address of the pattern memory 12, FIG. 3. While the particular key in the OFA area is continuously pressed, the ad lib pattern assigned to that key is repetitively read out of the memory 12. Hence, the ad lib pattern is automatically developed and changed by monitoring the development of chords in the accompaniment part. Such an operation is essentially the same as the conventional chord detection and automatic accompaniment technology.

On the control panel shown in FIG. 4, characters or similar symbols representative of the kinds of melodies and those representative of the kinds of rhythms are printed in the display sections P1 and P2, respectively.

In the figure, such symbols are simply represented by bars for simplicity. Specifically, timbres of piano, marimba and so forth are printed on the display section P1 in alphabets such as "PIANO" and "MARIMBA" (in abbreviated forms if necessary), while the names of rhythms such as waltz and rock are printed on the display section P1 in alphabets such as "WALTZ" and "ROCK". In the specific arrangement shown in FIG. 4, twenty-four kinds of timbres and twenty-four kinds of rhythms are available on the display sections P1 and P2, respectively. The switches SW1 positioned below the display section P1 are used to select a desired memory on the display section P1. Labels M1 and M6 are printed below the switches SW1. The switch M1, for example, glows when it is pressed, while one of the LEDs in the display section P1 glows at the same time. Every time the switch M1 is pressed, the LEDs in the display section P1 are turned on one after another from the uppermost one to the lowermost one. Therefore, one of the switches M1 to M6 and one of the LEDs which are glowing inform a person of the kind of melody currently set up. This is also true with the other display section P2 allocated to rhythms.

The musical instrument having the above construction will be operated as follows.

Figure 5:
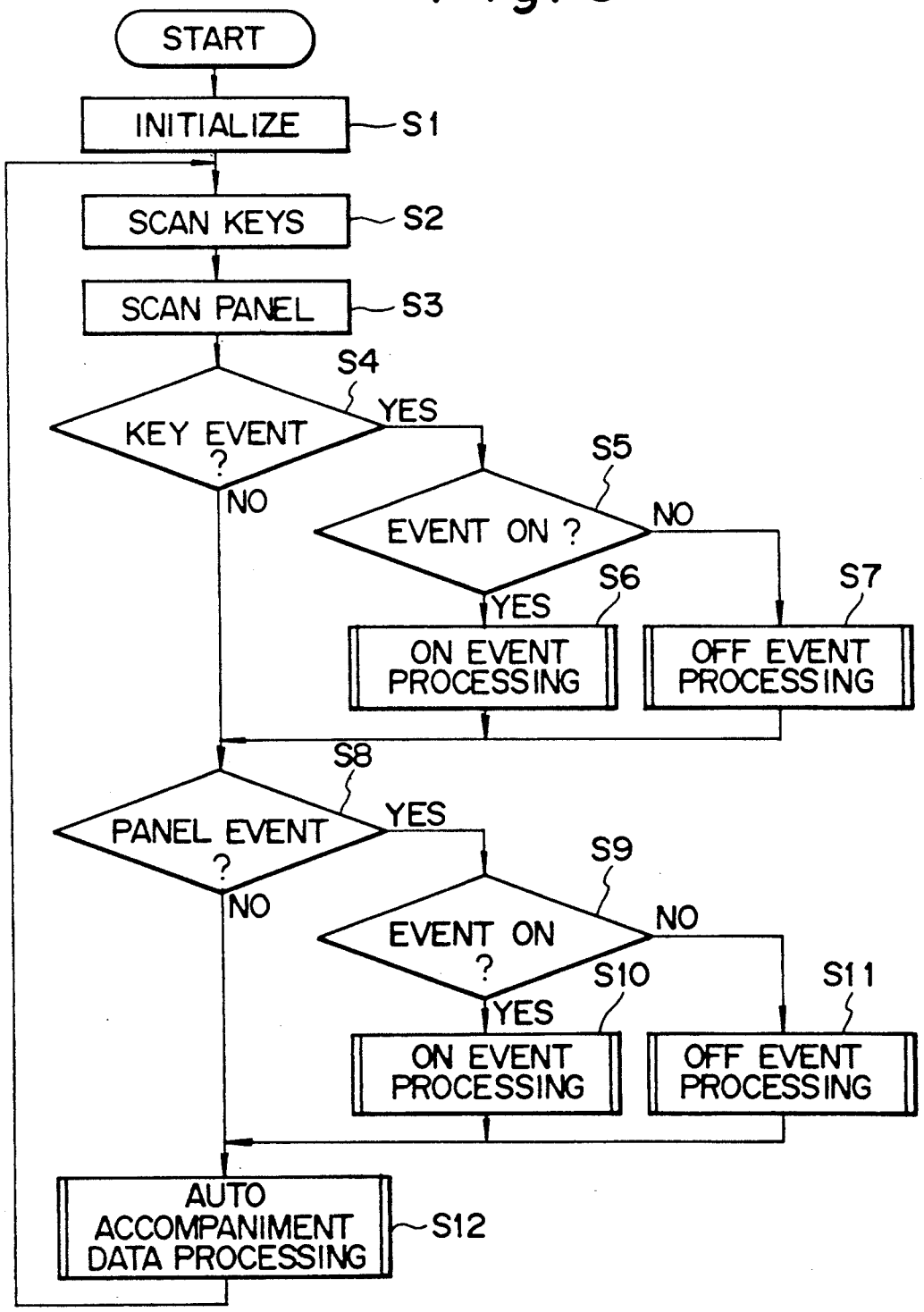
FIG. 5 is a flowchart representative of a main routine of the illustrative embodiment.

Referring to FIG. 5, a main routine which the instrument executes during a play is shown in a flowchart. When a main power source of the instrument is turned on, a step S1 is executed to initialize the instrument. Then, the statuses of the keys and those of the control panel are sequentially scanned in this order (steps S2 and S3). A change in the statuses of the keys is monitored in a step S4. When a key event occurs as determined by the step S4, whether or not any key has been depressed is determined (step S5). If the answer of the step S5 is YES, the program advances to a step S6 to execute ON event processing; if otherwise, i.e., when the pressed key is released, OFF event processing is executed (step S7). In an ad lib mode, OFA start processing begins in the step S6 (ON event processing), and data are read out in a step S12 which will be described. In the step S7, processing for ending the read-out of ad lib pattern is executed. Such read-out starting and ending sequences will be described more specifically with reference to FIG. 7. The start and stop may be implemented by a read enable flag which is selectively set and cleared.

If the answer of the step S4 is NO or when the processing in the step S6 or S7 is completed, a step S8 is executed for determining whether or not a panel event has occurred. For this purpose, the statuses of the control panel are constantly monitored. If the answer of the step S8 is YES, whether or not any of the switches on the control panel has been pressed is determined (step S9). If the answer of the step S9 is YES, ON event processing is executed (step S10). If the answer of the step S9 is NO, i.e., when the switch-on state is terminated, OFF event processing is executed (step S11). The steps S8 to S11 described so far constitute panel scan processing which is responsive to the statuses of the various switches provided on the control panel shown in FIG. 4, e.g. mode selecting switch 4, ad lib selecting switch 6, and switches SW1 and SW2. If the answer of the step S8 is NO or when the processing in the step S10 or S11 is completed, the program advances to a step S12 for reading out pattern data representative of tones.

The steps S2, S4, S5 and S6 adapted for key event processing will be described in detail with reference to FIG. 6. The procedure shown in FIG. 6 begins with a step S21 for setting up one of the normal play mode, automatic play mode and drum play mode in response to the manipulation of the mode selecting switch 4. When a key event occurs on the keyboard as determined by a step S22, whether the pressed key belongs to the lower key area is determined (step S23). If the answer of the step S23 is NO, whether or not the ad lib play (OFA) mode has been selected is determined (step S24). If the answer of the step S24 is YES, whether or not the pressed key belongs to the OFA area is determined (step S25). If the answer of the step S25 is YES, a step S26 is executed for setting a pattern address of the pattern memory 12 corresponding to the pressed key. Then, pattern data is read out of the set address of the pattern memory 12 (step S27). If the answer of the step S24 or S25 is NO, the operation is transferred to a step S30 for executing normal processing.

If the answer of the previously stated step S23 is YES, a step S28 is executed to identify a mode currently set up. If the current mode is the normal play mode, the operation is also transferred to the step S30. If the current mode determined by the step S28 is the automatic play mode, whether or not auto-rhythm has been set up is determined (step S29). If the answer of the step S29 is NO, bass/chords are read out (step S31); if otherwise, only chords are determined (step S32). If the current mode is the drum play mode, the step S28 is followed by a step S33 for producing drum sound. The step S27, S30, S31, S32 or S33 is followed by a step S34 for executing the next processing.

Figure 6:
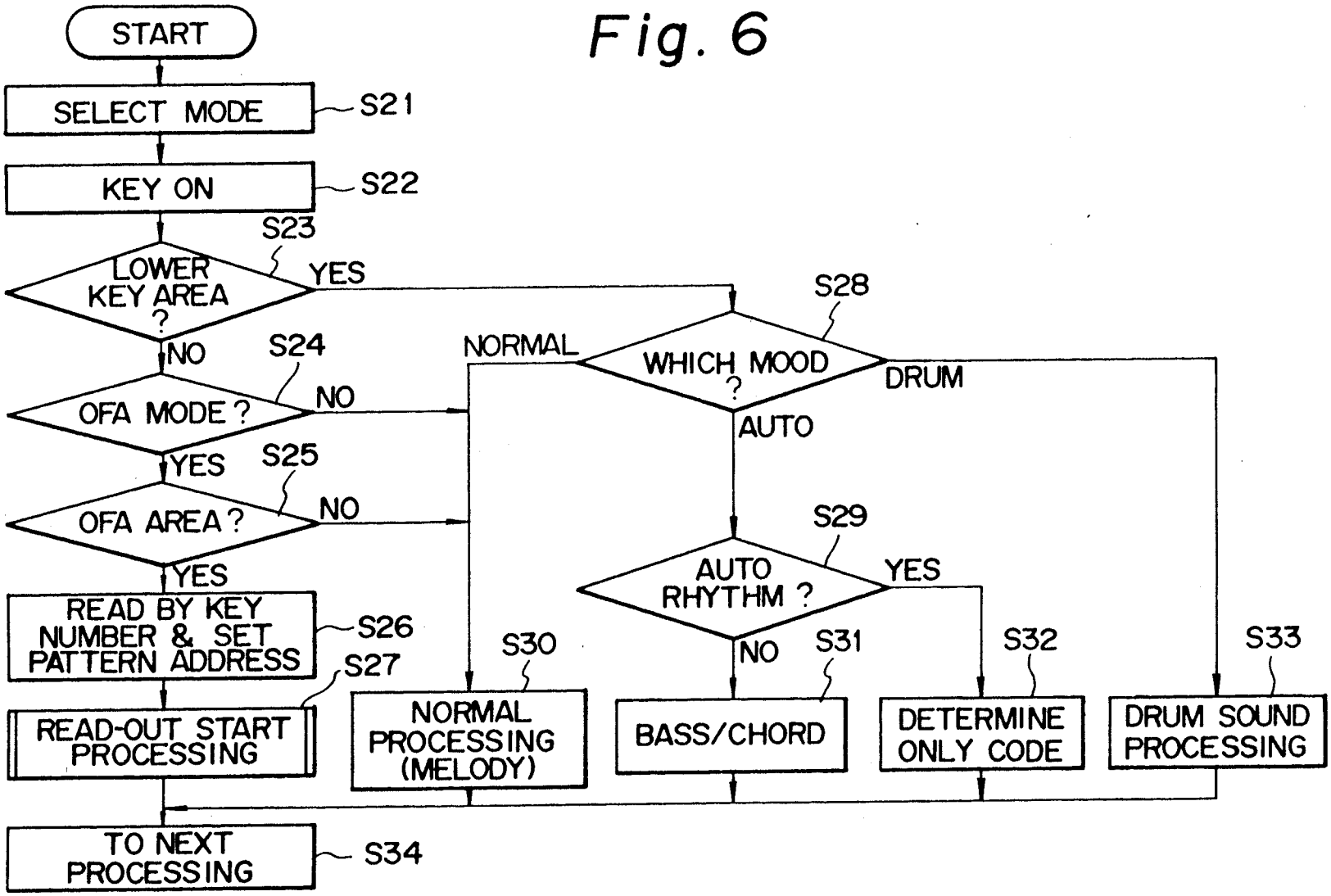
FIG. 6 is a flowchart showing a pattern data read-out starting sequence in various play modes specifically.

In the illustrative embodiment, when the ad lib play mode is selected, the address associated with note data which is representative of a single melody is designated by the steps S26 and S27 shown in FIG. 6. While the particular key is continuously pressed, the ad lib play is repetitively executed.

The data read-out processing constituted by the steps S26 and S27 of FIG. 6 will be described more specifically with reference to FIG. 7. This processing corresponds to the automatic play data read-out processing (step S12) included in the routine of FIG. 5.

Figure 7:
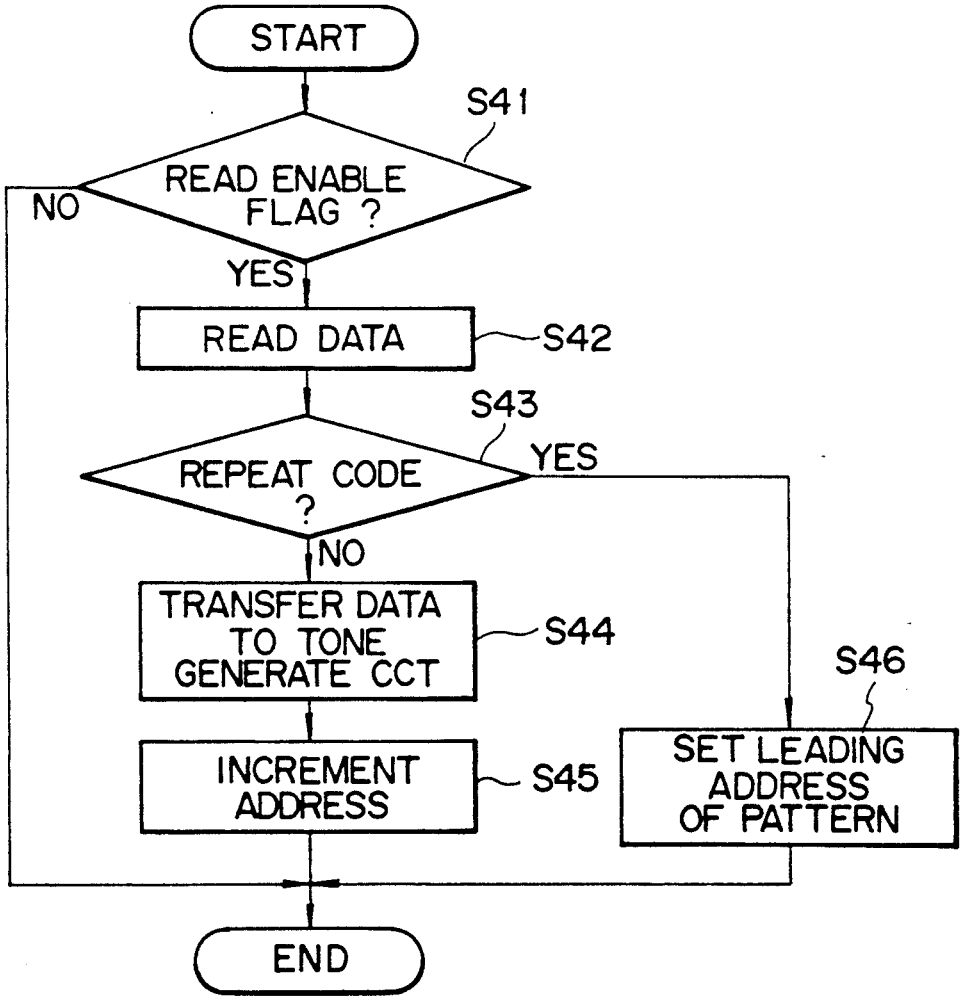
FIG. 7 is a flowchart showing a pattern data reading sequence in various modes specifically.

Specifically, FIG. 7 indicates how the pattern data associated with a selected mode are read out in detail. The procedure begins with a step S41 for determining whether or not a read enable flag is set. If the answer of the step S41 is YES, the data are read out of the associated pattern memory. Then, whether or not a repeat code is set is determined (step S43). If the answer of the step S43 is YES, a step S46 is executed for temporarily storing the read automatic rhythm play pattern (e.g. in an area of the RAM 8, FIG. 1) while setting the leading address of the pattern of the memory area. In the automatic play mode, for example, the pattern data will be read out of the automatic rhythm play pattern memory 11 while, in the ad lib play mode, the ad lib pattern will be read out of the ad lib pattern memory 12. If the answer of the step S43 is NO, the program advances to a step S44 for transferring the read data to the tone generating circuit 13, FIG. 1. The step S44 is followed by a step S45 for advancing to the next address. In the drum play mode or the normal play mode, for example, data read out of the tone waveform memory 10 will be fed to the tone generating circuit 13.

In the ad lib play mode, for example, the procedure described above causes an ad lid pattern associated with a key being depressed in the OFA area to be repetitively read out. The ad lib pattern is automatically developed and changed in response to the development of chords of an accompaniment part. Specifically, note data representative of a single melody are looped or, based on detected chords, transformed into a plurality of melodies. This allows an ad lib play to be executed by using one or two measures of note data (or one half or one quarter of a measure of note data, if desired). To control the read-out of such note data, the individual note data are counted by a timer count program, for example.

Figure 8:
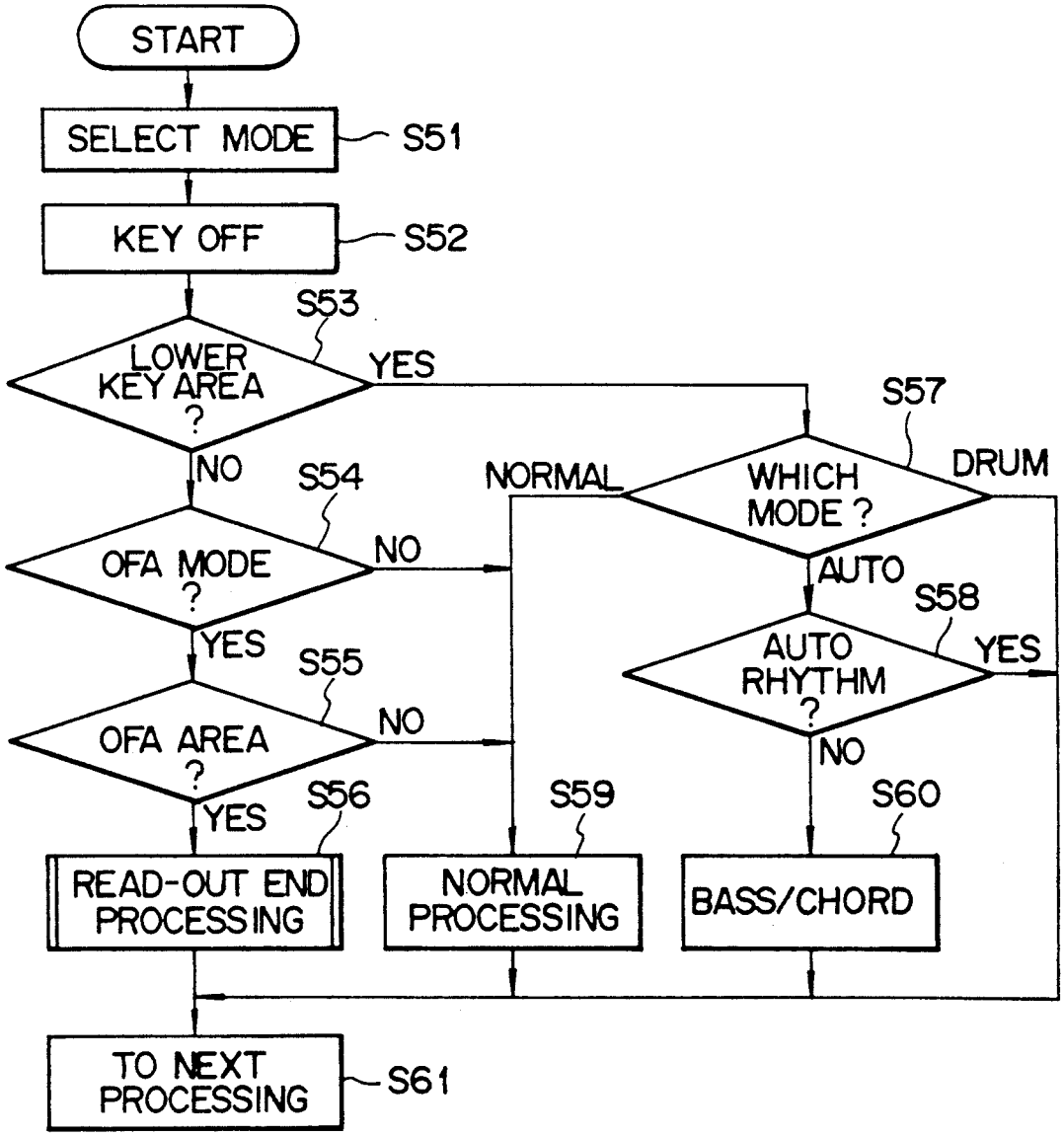
FIG. 8 is a flowchart showing a pattern data read-out ending sequence in various modes specifically.

Referring to FIG. 8, there is shown a sequence of steps which occurs when the pressed key in the OFA area is released, i.e., when the read-out of pattern data in any of the play modes is to be ended. Specifically, FIG. 8 indicates the OFF event processing (step S7) of FIG. 5 in detail. While the end procedure of FIG. 8 is generally analogous to the start procedure of FIG. 6, the former is different from the latter in that, when a key OFF event occurs in the ad lib play mode as determined by a step S52, the key having been turned on in the OFA area is turned off. In response, the data read-out processing is ended in a step S56. The rest of the procedure is the same as the start procedure of FIG. 6.

The embodiment has been shown and described as being operable in three different play modes, i.e., normal play mode, automatic play mode, and drum play mode. It is to be noted, however, that the present invention is similarly applicable to a musical instrument having the normal play mode and automatic play mode only. Of course, the present invention is practicable with a musical instrument operable in a percussion mode or similar mode in addition to the normal play and automatic play modes.

Referring to FIGS. 9A and 9B, the functions available with the present invention in the various play modes are summarized. In FIG. 9A, the words "internal sequence" shown in the column which is distinguished by *1 refer to a sequence adapted for the kinds of chords (C, $C_7$, Dm, F, etc.) and time data, the rotation of OFA data, and the rotation of auto-rhythm. In FIG. 9B, while OFA is OFF, the mode SW is AUTO, and auto-rhythm is ON (column distinguished by *2), only the drum sound is produced although a rhythm has been started; when one of the lower keys is pressed, bass/-chord is outputted. The functions shown in FIGS. 9A and 9B are implemented by the sequences shown in FIGS. 5 to 8. To facilitate an understanding of the operation in the ad lib play mode, FIGS. 9A and 9B show respectively the OFA (ad lib selecting switch 6) ON state and the OFA OFF state and the normal play mode, automatic play mode and drum play mode associated with the OFA ON and OFA OFF states.

Assume that in the OFA ON state shown in FIG. 9A, the normal play mode is selected and auto-rhythm is ON. Then, when one of the seventeen keys located in the OFA area is pressed, ad lib patterns each being associated with a different key are repetitively read out and are developed by the internal sequence to execute an ad lib play. In the automatic play mode, ad lib patterns associated with the individual keys in the OFA area will also be repetitively read out as in the normal play mode, so long as the lower keys are not pressed. These patterns will be developed by the internal sequence for ad-libbing. Further, in the drum play mode, ad lib patterns associated with the individual keys in the OFA area will also be repetitively read out as in the normal play mode (with auto-rhythm being ON) and developed by the internal sequence. Hence, when the ad lib play mode is selected, ad-libbing can be effected in all of the cases which are indicated by circles in the second column from the right in FIG. 9A.

In summary, it will be seen that the present invention provides an electronic instrument which allows even a person not familiar with playing techiniques to enjoy ad-libbing which matches any particular program. The instrument, therefore, will help persons have familiarity with electronic musical instruments and will contribute not only to the popularization of such instruments but also to musical education which plays an important role in the cultivation of artistic sentiments. The capacity of the ad lib pattern memory 12 is saved because note data representative of a single melody can be looped or, by chord detection, transformed to a plurality of melodies so as to implement various kinds of ad libs. The ad-libbing function of the instrument of the present invention is achievable with hardware which is essentially the same as the hardware of conventional instruments of the type described, achieving an advantage in the aspect of cost also.

Various modifications will become possible for those skilled in the art after receiving the teachings of the present disclosure without departing from the scope thereof.

What is claimed is:

1. An electronic musical instrument having an ad-libbing function, comprising:

a keyboard having a plurality of keys arranged thereon;

tone generating means;

storing means for storing ad lib melody patterns corresponding to keys in a prescribed range on said keyboard respectively and;

ad lib selecting switch means for controlling said tone generating means and said storing means to selectively operate in an ad lib play mode in which said tone generating means generates ad lib melodies corresponding to said stored ad lib melody patterns when the respective keys in said prescribed range are pressed.

2. An electronic musical instrument having an ad-libbing function, comprising:

a keyboard having a plurality of keys arranged thereon;

a key assigner;

first storing means for storing tone waveforms;

tone generating means;

system control means for controlling, when any of said keys are pressed, said key assigner and said tone generating means to generate tones associated with said pressed keys;

automatic rhythm playing means;

mode selecting switch means for selectively setting up a normal play mode, an automatic play mode, and a drum play mode;

second storing means for storing ad lib melody patterns corresponding to keys in a prescribed range on said keyboard respectively; and ad lib selecting switch means for selectively controlling said system control means to operate in an ad lib play mode in which said tone generating means generates ad lib melodies corresponding to said stored ad lib melody patterns when the respective keys in said prescribed range are pressed.

3. An electronic musical instrument having an ad-libbing function, comprising:

a keyboard having a plurality of keys arranged thereon;

a key assigner;

first storing means for storing tone waveforms;

tone generating means;

system control means for controlling, when any of said keys on said keyboard are pressed, said key assigner and said tone generating means to generate tones associated with said pressed keys;

second storing means for storing data representative of rhythm patterns and kinds of chords of rhythms;

automatic rhythm playing means for playing rhythms by reading said data representative of rhythm patterns and said kinds of chords of rhythms;

mode selecting switch means for selectively setting up a normal play mode in which said keys on said keyboard are used to produce normal sound for a normal play, an automatic play mode having a function of executing an automatic play by assigning one or more of said keys of said keyboard which lie in a particular range as keys for automatic accompaniment while assigning the other keys as keys for a normal sound play, and a drum play mode having a function of executing a drum play by assigning said keys lying in a prescribed range as keys for percussive sounds while assigning the other keys as keys for a normal sound play;

third storing means for storing ad lib melody patterns corresponding to keys in a prescribed ad lib section of said keyboard respectively; and ad lib selecting switch means for setting up an ad lib play mode in which said keys in said ad lib section are used to produce ad lib melodies corresponding to said stored ad lib melody patterns respectively.

4. An electronic musical instrument as in claim 1, in which:

said storing means further stores individual tone data corresponding to said keys; and said ad lib selecting switch means further controls said tone generating means and said storing means to selectively operate in a normal play mode in which said tone generating means generates individual tones corresponding to said individual tone data when the respective keys in said prescribed range are pressed.

* * * * *